US007926238B2

(12) United States Patent
Sareyka et al.

(10) Patent No.: US 7,926,238 B2
(45) Date of Patent: Apr. 19, 2011

(54) STAB-IN CONNECTOR

(75) Inventors: Brett W. Sareyka, West Chester, PA (US); Yu Lin, Blue Bell, PA (US); William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 10/754,323

(22) Filed: Jan. 9, 2004

(65) Prior Publication Data

US 2005/0166509 A1 Aug. 4, 2005

(51) Int. Cl.
*E04B 9/10* (2006.01)
*E04B 9/34* (2006.01)

(52) U.S. Cl. ..... 52/506.06; 52/506.07; 52/506.1; 52/506.09

(58) Field of Classification Search ..... 52/506.01, 52/506.05, 506.06, 506.07, 506.08, 506.09, 52/506.03, 506.04, 506.1, 512
See application file for complete search history.

(56) References Cited

U.S. PATENT DOCUMENTS 3,193,063 A 7/1965 Brown et al.
3,312,488 A * 4/1967 Lickliter ..... 403/263
3,321,879 A * 5/1967 Purdy ..... 52/232
3,354,598 A * 11/1967 Nicholson ..... 52/506.07
3,367,695 A 2/1968 Haertel et al.
3,396,997 A 8/1968 Adams
3,501,185 A 3/1970 Brown et al.
3,675,957 A * 7/1972 Lickliter et al. ..... 403/252
3,746,379 A * 7/1973 Sauer ..... 403/2
3,921,363 A * 11/1975 Beynon ..... 403/219
3,922,829 A 12/1975 Sauer
3,979,874 A * 9/1976 Cubbler et al. ..... 52/664
4,106,878 A 8/1978 Jones
4,108,563 A * 8/1978 Brown et al. ..... 403/347
4,161,856 A * 7/1979 Brown et al. ..... 52/667
4,314,432 A * 2/1982 Rosenbaum ..... 52/506.07
4,317,641 A * 3/1982 Sauer ..... 403/347
4,364,686 A 12/1982 Sharp et al.
RE31,201 E * 4/1983 Sauer ..... 52/667
4,389,828 A * 6/1983 Cary ..... 52/665
4,494,350 A * 1/1985 Sharp ..... 52/665
4,499,697 A 2/1985 La Londe
4,525,973 A * 7/1985 Vukmanic et al. ..... 52/667
4,535,580 A 8/1985 Shirey
4,549,383 A 10/1985 Vukmanic et al.
4,601,153 A * 7/1986 Dunn et al. ..... 52/666
4,611,453 A * 9/1986 Worley ..... 52/667
4,621,474 A 11/1986 Worley
(Continued)

OTHER PUBLICATIONS

See attached European Patent Office Action, dated Oct. 5, 2006, in European Patent Application No. 04026847.6.

(Continued)

*Primary Examiner* — Jeanette E. Chapman
(74) *Attorney, Agent, or Firm* — Eugene Chovanes

(57) ABSTRACT

A stab-in connector that locks with an opposing identical connector, through a slot in the main beam of a suspended ceiling grid. The connector has a straight locking latch that is cantilevered from a bend at a base of the connector. The bend is in the form of an arc. The bend forms a pivot for the latch. Contact between the cantilevered straight locking latch and the side of the slot is delayed as the connector is being stabbed into the slot. During the delay, the connectors are positioned within the slot, and relative to each other, so that substantially less force is needed than the force that was necessary to engage prior art stab-in connectors into locking position.

1 Claim, 4 Drawing Sheets

U.S. PATENT DOCUMENTS

| | | | | | |
|---|---|---|---|---|---|
| 4,648,230 | A | | 3/1987 | Mieyal et al. | |
| 4,712,350 | A | | 12/1987 | Vukmanic | |
| 4,779,394 | A | | 10/1988 | Shirey et al. | |
| 4,785,603 | A | * | 11/1988 | Platt | 52/667 |
| 4,827,681 | A | | 5/1989 | Platt | |
| 4,864,791 | A | | 9/1989 | Platt | |
| 4,912,894 | A | | 4/1990 | Platt | |
| 4,989,387 | A | * | 2/1991 | Vukmanic et al. | 52/667 |
| 5,044,138 | A | | 9/1991 | Zaccardelli et al. | |
| 5,216,865 | A | | 6/1993 | Lalonde et al. | |
| 5,271,202 | A | * | 12/1993 | Vukmanic et al. | 52/667 |
| 5,517,796 | A | | 5/1996 | Koski et al. | |
| 5,687,525 | A | * | 11/1997 | Koski et al. | 52/506.07 |
| 5,839,246 | A | * | 11/1998 | Ziegler et al. | 52/506.07 |
| 5,966,887 | A | * | 10/1999 | Mieyal | 52/506.07 |
| 6,178,712 | B1 | | 1/2001 | Sauer | |
| 6,199,343 | B1 | * | 3/2001 | Sauer et al. | 52/664 |
| 6,305,139 | B1 | * | 10/2001 | Sauer | 52/506.07 |
| 6,523,313 | B2 | * | 2/2003 | Platt et al. | 52/506.06 |
| 6,729,100 | B2 | * | 5/2004 | Koski et al. | 52/506.05 |

OTHER PUBLICATIONS

See attached Response, dated Nov. 30, 2006, to European Patent Office Action dated Oct. 5, 2006.

See attached copy of Letters Patent for New Zealand Patent No. 536057, granted Oct. 12, 2006, titled Stab-in Connector.

See attached European Patent Office Action, dated Mar. 2, 2007, in European Patent Application No. 04026847.6.

See attached Response, dated Apr. 10, 2007, to European Patent Office Action dated Mar. 2, 2007.

See Attached Copy of European Search Report Issued by European Patent Office on May 31, 2006 in European Patent Application No. 04026847.6.

* cited by examiner

IMPROVEMENT

IMPROVEMENT
FORCE (lbs.)
DISTANCE (X)
ΔX
30
25
20
15
10
5
0
80
81
82
83
84
90
91
92
93
94

STAB-IN CONNECTOR

BACKGROUND OF THE INVENTION

1. Field of the Invention

Suspended ceilings are used extensively in commercial and industrial buildings. In such ceilings, a metal grid framework of interconnected main beams and cross beams is hung from a structural ceiling by wires. The grid supports acoustical panels in rectangular openings formed in the grid.

This invention relates to the connectors used in the grid to join a pair of opposing cross beams and a main beam at grid intersections.

2. Prior Art

Suspended ceilings having metal beams interconnected into a grid that supports panels are well known. U.S. Pat. Nos. 5,839,246 and 6,178,712, for instance, incorporated herein by reference, show such ceilings.

The grid in such ceilings has, at each grid intersection, a pair of opposing cross beams and a main beam that form a connection.

The present invention relates to such a connection.

Each cross beam in such a connection has a connector at its end that is thrust, or stabbed-in, from opposing sides of the main beam, through a slot in the main beam. The connectors are all identical.

The connector that is first inserted into the slot is prevented from being withdrawn back out of the slot by the cantilevered latch in the connector, in the form of a pivoted flexible leaf spring. Such latch, which is integral with the connector base and formed therefrom by punching, is biased toward an open position. The latch, which is cantilevered at an angle from the base of the connector, flexes toward a closed position under the restraint of the side of the slot when the connector is stabbed through the slot to make the connection, but which then reflexes back to its biased rest position to prevent withdrawal of the connector back out of the slot.

Another connector on an opposing cross beam, identical to the first connector thrust through the slot, is then stabbed through the slot in the reduced space in the slot alongside the first. The latch on the connector contacts the side of the slot close to the latch pivot, and is flexed toward a closed position.

In inserting particularly the second connector into the slot, with a linear stab-in motion, substantial work and force are necessary to make the connection.

This resistance arises virtually immediately as the second connector into the slot enters the slot, and continues throughout the travel of the connector until it is seated in a locked position, as described below, with the first connector into the slot.

Both connectors interconnect when the second connector into the slot is fully inserted. Detents formed from the connector base, in the form of bulbs, that have a cam side and a locking side, and the ends of the connectors, flex and reflex to engage in what is sometimes referred to as a connector-to-connector lock, or "handshake" lock. Such a "handshake" connection between the connectors prevents the connectors from being pulled apart lineally out of the slot. The connectors are kept laterally and vertically together by the slot in the main beam.

In the seated locked position, the second connector is horizontally aligned with the first connector within the confines of the slot, so that the locking detents on the connectors are engaged and retained at the same level to form the connector-to-connector lock. Generally, the second connector must be either elevated or depressed as it passes into the slot to achieve such horizontal alignment. Hence, the profile of the leading edge of the connector is tapered to guide the connector during its travel though the main beam slot.

Such connectors are well known in the prior art and are disclosed, for instance, in the above referred to patents.

Numerous such connections must be made to create a ceiling grid.

SUMMARY OF THE PRESENT INVENTION

The prior art stab-in connector described above is improved so that it takes much less force, and less work, to make the connection.

There is less work and less force necessary, because, in inserting the second connector into the reduced area of the slot of the main beam, (1) there is a delay in the contact between the locking latch and the side of the slot, so that during the delay, (2) elements in the ensuing connection are positioned while offering the least resistance from frictional forces to such positioning, and (3) when contact between elements does occur, the elements are positioned to offer the least resistance to making a connection.

To achieve the above, the locking latch, which in its unflexed position, must extend laterally far enough out from the base of the connector to prevent withdrawal of the first connector through the slot before the second connector is inserted, is pivoted from the connector base in an arc, rather than in an acute bend as in the prior art.

This, as set forth in (1) above, delays contact between the latch and the side of the slot, when the second connector is inserted into the slot and, as set forth in (2) above, such contact is made further out along the latch from the pivot point, closer to the end of the latch, creating a longer lever arm, so that less force is needed to close the latch.

The outward end of the locking latch in an unflexed position, extends to the same position as the prior art straight latch pivoted at a sharp, acute angle. This position is necessary, so that the connector cannot be withdrawn after the latch passes through the slot.

Also, during the delay in (1) above, the second connector into the slot is being positioned vertically by the taper on the leading end of the connector, which engages either the top or bottom of the slot, to the same horizontal level as the first connector, without frictional resistance created in the connection of the prior art, where the locking latch, virtually immediately, forces the first and second connection laterally together.

By adjusting the second connector into the slot more quickly vertically as it travels through the slot, the locking detents and connector ends that engage together by flexing, are in a position, as set forth in (3) above, to offer the least resistance to such engagement.

BRIEF DESCRIPTION OF THE DRAWINGS

FIG. 3 is a side elevational view of a prior art connector.

FIG. 3*a* is a top sectional view of a prior art connector taken on the line A-A of FIG. 3, with an enlarged circled portion showing a prior art latch.

DESCRIPTION OF THE PREFERRED EMBODIMENT

The Prior Art

U.S. Pat. No. 5,839,246, incorporated herein by reference, is representative of the prior art connection which is improved by this invention. The connection itself, and the method of making such connection, is set forth in detail in the '246 patent.

Figure 1:
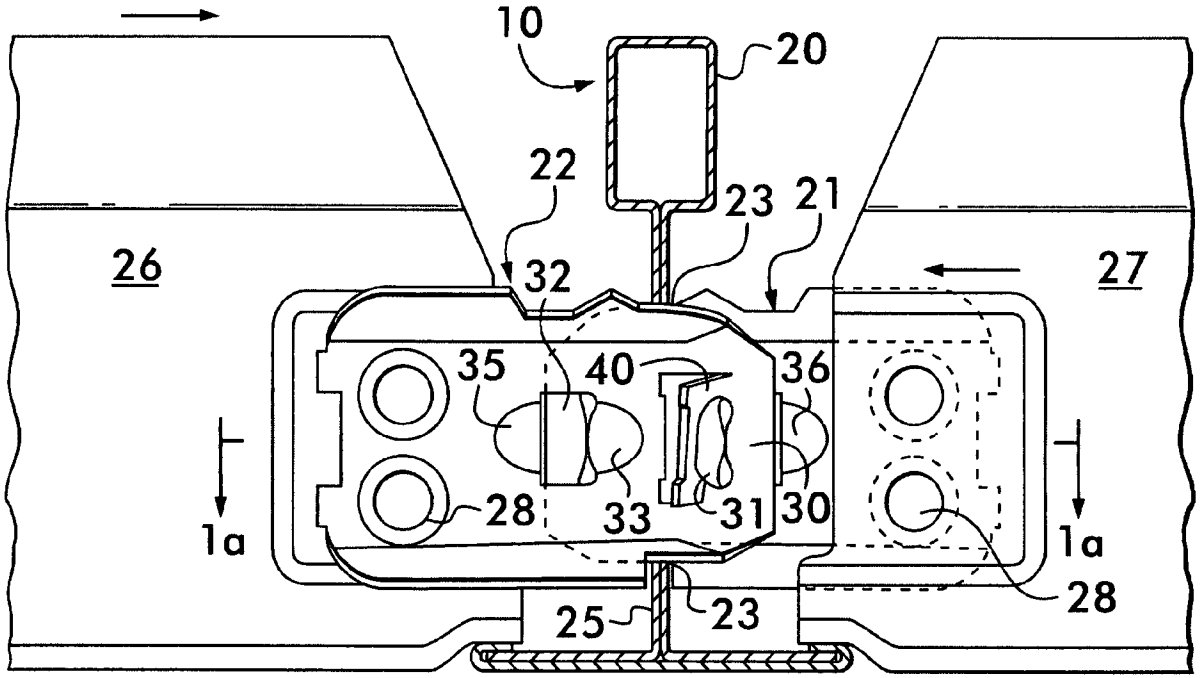
FIG. 1 is a right side elevational of a connection of two cross beams through a slot in the main beam, showing the connectors of the invention engaged in a connector-to-connector lock.
Figure 1A:
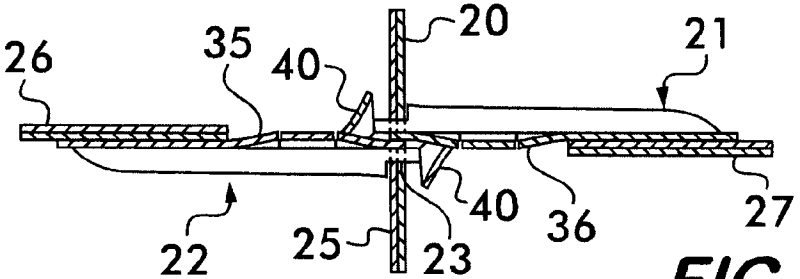
Figure 2A:
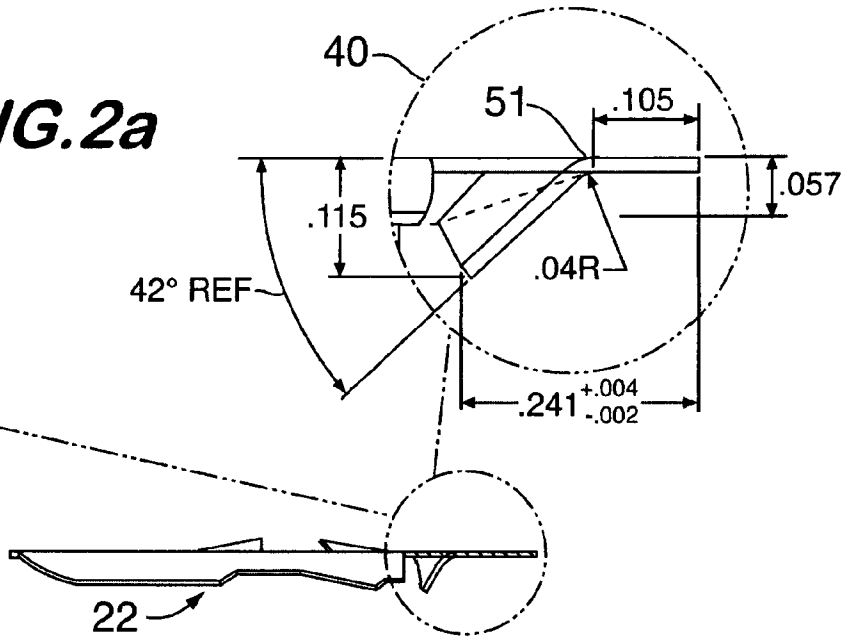
FIG. 2*a* is a top sectional view of the connector of the invention, taken on the line A-A of FIG. 2, with an enlarged circled portion showing the latch of the invention.
Figure 2:
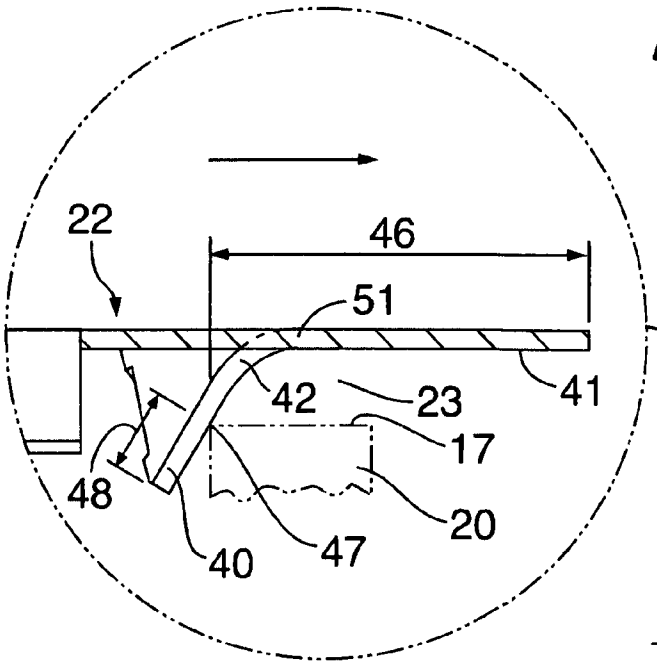
FIG. 2 is a right side elevational view of the connector of the invention, shown in the connection of FIG. 1.
Figure 2:
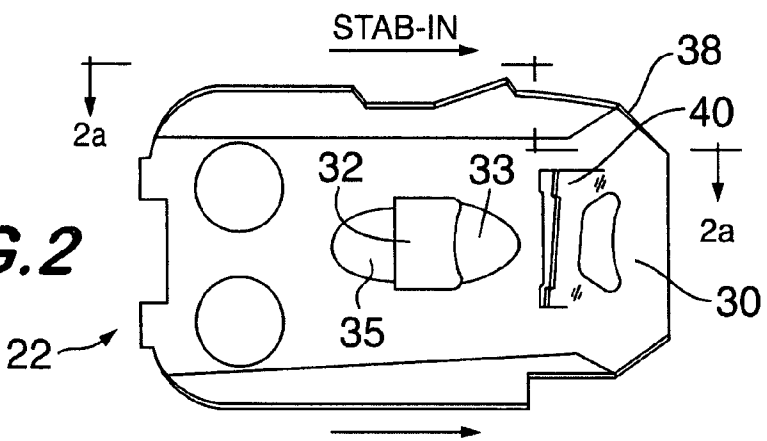

In the present drawings, a connection of the invention is shown in FIGS. 1, 1*a*, with the improvement of the invention shown more clearly in FIGS. 2 and 2*a*. In the present connection, main beam 20, shown in cross section, extends longitudinally in a ceiling grid. Identical connectors 21 and 22 have been stabbed through a slot 23 in the web 25 of the main beam 20 and interconnect. The connectors 21 and 22 are connected respectively to cross beams 26 and 27 by rivets at 28.

In the connection, the following occurs:

(1) End 30 of connector 21 engages detent 31 to form a connector-to-connector connection, as does end 32 of connector 22 engage detent 33;

(2) Locking latches 40 on connector 21 and connector 22 are in an unflexed position;

(3) Backstops 35 and 36 on connectors 21 and 22 secure the ends 30 and 32 in the connector-to-connector lock; and (4) Connectors 21 and 22 are kept laterally and vertically constrained within slot 23 by the cross sectional configuration of the connectors, as well known in the art.

The general configuration so far described conforms to the prior art.

In making the connection shown in FIGS. 1 and 1*a*, and in the cited patents, a first connector, either connector 21 or 22, both being identical, is thrust or stabbed through the slot 23 in the prior art manner. In this explanation, it will assume connector 21 is first thrust through the slot.

Locking latch 40 contacts side of slot 23 and is flexed enough to allow the latch 40 to pass through slot 23 and reflex back to a rest position, in a one way movement. In this position, the first connector 21 through the slot is retained within the slot 23.

The second connector 22 is then thrust through the slot 23 along side the first connector 21 through the slot 23. Again, locking latch 40 contacts side of slot 23, but now there is less room in the slot because a connector has already been inserted. The second connector 22 into the slot, as it is thrust through the slot 23, flexes the latch 40 toward a closed position, until the latch passes through the slot after which it flexes open to a rest position. The connectors 21 and 22 also form a connector-to-connector lock at this point, as seen in FIG. 1, wherein the detents 31 and 33 and the beam ends 30 and 32 have flexed and then reflexed into a locked position, at rest.

In these stab-in connections, as the second connector into the slot, for instance connector 22, travels through the slot 23 to a seated position, after the first connector 21 into the slot has been inserted, the following occurs:

(1) The second connector 22 is adjusted vertically within the slot 23.

(2) The second connector 22 is forced laterally by a side of the slot 23 against the first connector 21.

(3) The locking latch 40 on the second connector 22 is flexed toward a closed position by a side of the slot 23 until the latch 40 passes through the slot 23, and then it springs open to a rest position as seen for instance in FIG. 1.

(4) The locking detents 31 and 33 and connector ends 30 and 32 on the first and second connectors 21 and 22 are flexed apart as they contact one another, and then reflexed into a locking position.

In the prior art, (1) through (4) above overlapped or occurred virtually simultaneously, so that the force and work required to complete a connection 10 was not only the sum of the forces necessary to overcome the sum of the individual resistances created by (1), (2), (3) and (4) referred to immediately above, but also the force and work to overcome the friction created when forces (1), (2), (3) and (4) overlapped, or occurred simultaneously. These frictional resistances included:

a. The friction between the latch 40 on the second connector 22 and the side of the slot 23 as the second connector 22 was being positioned vertically in the slot 23.

b. The friction laterally between the base of the connectors 21 and 22.

c. The friction between the top or bottom of the second connector 22 and the top or bottom of the slot 23 as the second connector 22 was being positioned vertically within the slot 23.

d. The friction between the detents 31 and 33 and ends 30 and 32 on the first connector 21 into the slot and second connector 22 into the slot 23 as the second connector 22 was being vertically positioned within the slot 23.

Figure 3A:
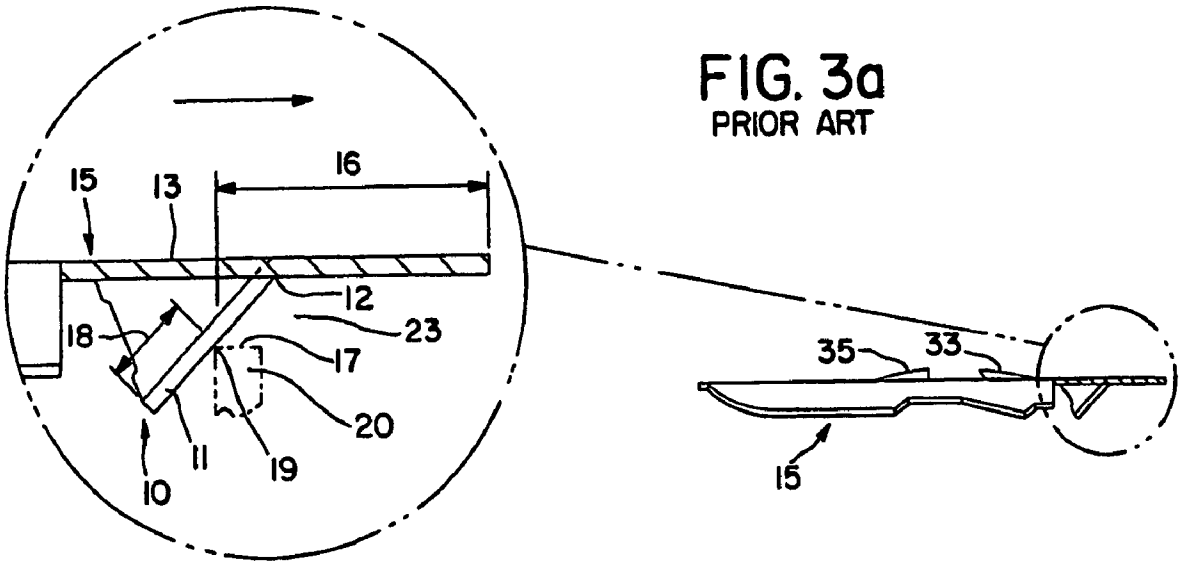
FIG. 3a PRIOR ART
FIGS. 3 and 3*a* are views of a prior art corresponding to the views of FIGS. 2 and 2*a*.
Figure 3:
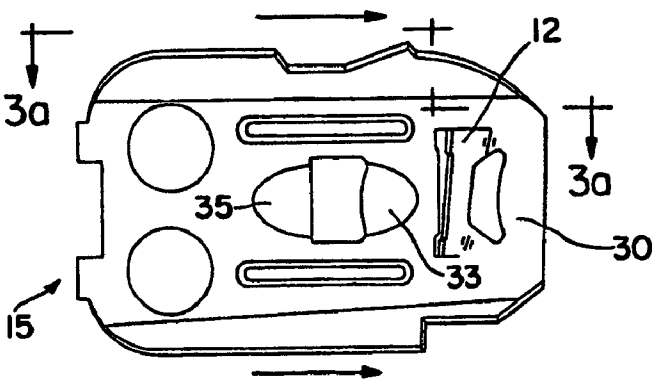
FIG. 3 PRIOR ART

In the prior art, in an attempt to reduce the total force and work required, the taper 37 or slope on the leading edge of a prior art connector 15, as seen in FIG. 3, was made at a gradual incline, so the frictional forces could be spread throughout the length of the insertion, as the second connector into the slot 23 was being adjusted vertically.

The Present Improvement

The present improvement reduces substantially the force necessary to overcome the resistance from the frictions (a), (b), (c) and (d) above and the forces necessary in (3) above to flex the locking latch 40 of the invention toward a closed position, and in (4) above to flex the detents 31 and 33 and ends 30 and 32 relative to one another to create the connector-to-connector interlock.

As in the prior art, in the present improvement the cantilevered leaf spring latch 40 continues to be formed, as by punching, from the connector base 39, as seen, for instance, in FIGS. 2 and 2*a*. The latch of the prior art, designated 10 as seen in FIGS. 3 and 3*a*, is in the form of a straight lever 11, pivoted at 12. It forms an acute sharp angle with the base 13 of prior art connector 15.

In the improvement of the invention, the latch of the invention 40, as seen in FIGS. 2 and 2*a*, herein, is formed from the base 41 with a radius 42, for instance 0.04 inches, before extending in straight lever fashion. The straight portion 43 of the latch of the invention 40 forms an angle of about 42° with the base 41. Such a curve in locking latch 40 increases the distance 46 the second connector 21 or 22, enters into the slot 23 before it contacts the side of the slot 23 at 47 to create a resistance from such latch of the invention 40 against the side of the slot 23. Such a curved locking latch of the invention 40 also reduces the distance 48 the latch of the invention 40 is in contact with the side of the slot 23 as it is being flexed toward a closed position as it passes through the slot 23, since it contacts the latch 40 closer to the end of the latch than does prior art straight latch 10.

Representative dimensions for the locking latch 40 of the invention are shown in FIG. 2*a*.

Further, the first contact of the latch of the invention 40 with the side of the slot 23 is further out from the point 51 of the latch of the invention 40 where it is joined to on the base 41, since part of the curved part of the latch of the invention 40 extends in the plane of the base 41 and is not exposed to contact by the side of the slot 23. Point 51 is the cutting start and the bending start of the latch of the invention 40 as seen in FIG. 2*a*.

Thus, the force exerted by the side of the slot 23 as the latch of the invention 40 passes through the slot is applied further from the pivot point 51 than in the prior art, thus requiring less force to pivot the latch of the invention 40, than in the prior art straight lever latch 10, since the force has a greater lever arm in the latch of the invention 40 when it meets the side of slot 23 as it is thrust into the connection.

Thus, less force over a shorter distance is required to collapse the latch of the invention 40 than was required to collapse latch 10 in the prior art. This results in substantially less work that has to be done to make a connection. This beneficial effect in one connection, is multiplied by the many connections required in forming a ceiling grid for a suspended ceiling.

In the connection improved by the present invention, during the time the connector is being inserted, it is necessary to adjust the connector vertically, so that when fully inserted, the connector fits vertically into the slot 23.

Since the force necessary to collapse the latch 10 of the prior art was substantial, and arose near the leading edge of the connector, the taper that guided the connector vertically to its fully seated position so that the connector was in place vertically when fully inserted, was gradual, to limit the added resistance at any one point in the insertion.

Thus, even when the connector-to-connector interlock was being created, wherein the detents were flexing, the connector was still being adjusted vertically, in view of such necessity to make the taper gradual rather than abrupt, thereby creating still more resistance.

In the present invention, the taper 38 at the leading edge of the connector 21, 22 is made relatively abrupt, at a steeper angle, so that a relative immediate adjustment is made vertically to the connector as it is being inserted into the slot 23. Even though a more steep, immediate adjustment would normally require a greater insertion force than that of a gradual insertion, there is less, rather than more force required. This reduction in force is obtained by the delayed contact of the locking latch of the invention 40 with the side of slot 23, since there is virtually no drag or resistance from the locking latch of the invention 40.

There is a further benefit that is achieved by early vertical positioning of the connector within the slot 23 during insertion. As the detents 31 and 33, and the ends 30 and 32 of the first and second connectors of the invention 20 and 21 come into contact, the detents and ends are at a position relative to one another, vertically, where there is least resistance to flexing of these elements laterally into the locking position. Whereas in the prior art, contact was made between detents and ends, and force was exerted between these elements, off-center from their most flexible position, the force required to flex the detents and ends, was again substantial.

FIGS. 3 and 3*a* show a prior art connector, while FIGS. 2 and 2*a* show a connector with the improvement of the invention.

As seen in FIGS. 3 and 3*a*, prior art latch 10 in the form of straight lever 11, is pivoted at an acute angle to base 13 of a prior art connector 15. Dotted line 17 represents, in the enlarged portion, the side of slot 23 as the connector 15 of the prior art is inserted into the slot 23. The prior art connector 15 travels the distance at 16 before it encounters the side of the slot at 19, which is at a distance 18 from the end of the prior art latch 10.

In FIGS. 2 and 2*a*, there is shown the connector of the invention 22, which is identical to the connector of the invention 21, with the latch of the invention 40. Again, as in FIG. 3*a*, dotted line 17 in the enlarged portion, represents the side of slot 23 as the connector 22 is inserted into the slot 23. The connector 22 travels the distance 46 before it encounters the side of the slot 23 at 47. This is a distance 48 from the end of the latch of the invention 40.

Figures 4, 4A, 4B, 4C:
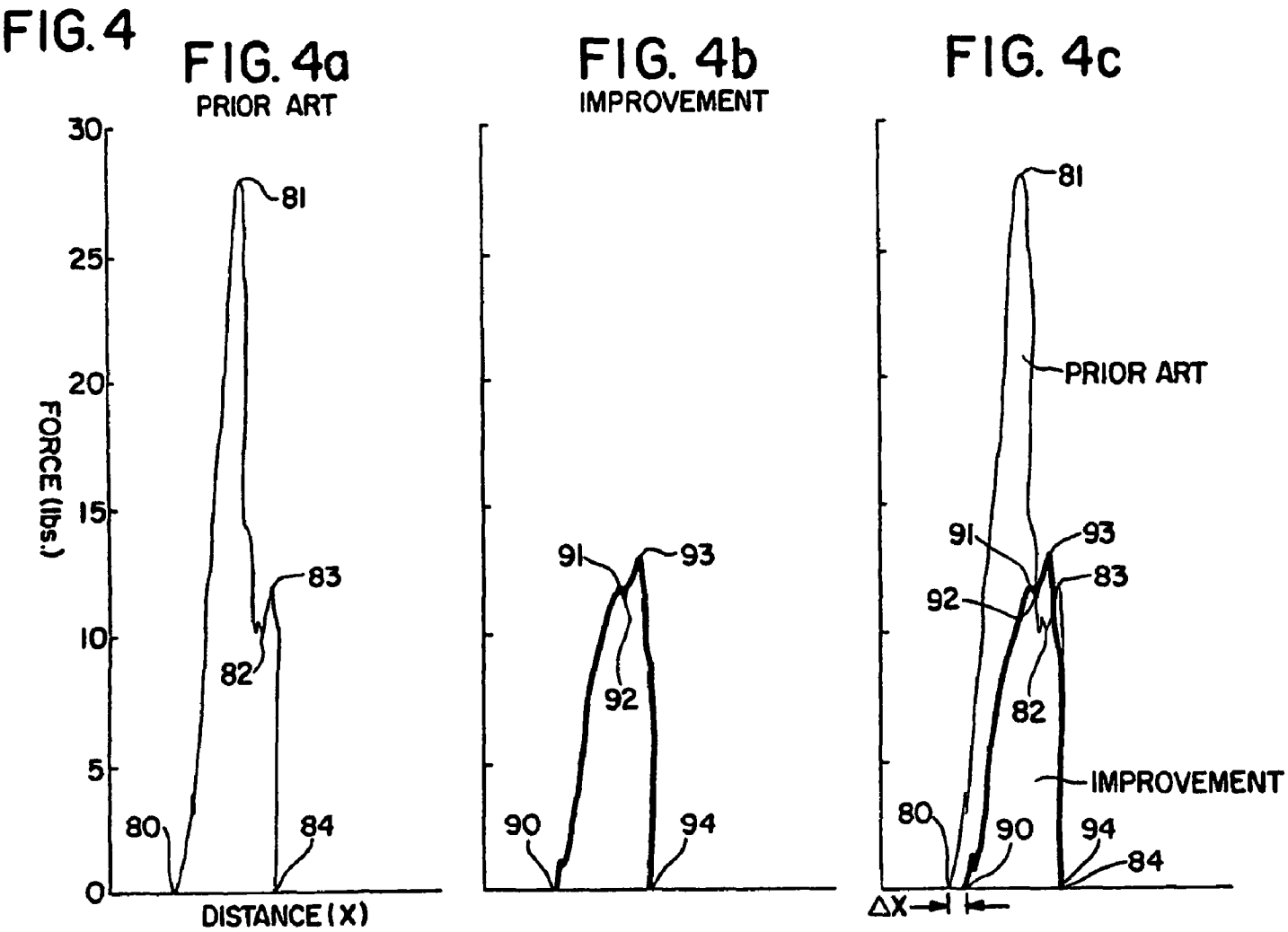
FIG. 4a PRIOR ART
FIG. 4c PRIOR ART
FIG. 4 is a group of graphs, 4*a*, 4*b*, and 4*c* which represent the forces involved in making a connection.
FIG. 4*a* is a graph of the force necessary to overcome resistance in making the connection of the prior art.
FIG. 4*b* is a graph of the force necessary to overcome resistance in making the connection of the invention.
FIG. 4*c* is a graph of the forces represented in 4*a* and 4*b*, overlapped.

The benefits of the present improvement over the prior art are shown graphically in FIGS. 4*a*, 4*b*, and 4*c*.

FIG. 4, including 4*a*, 4*b*, and 4*c*, shows the resistances encountered in a prior art connection compared to the forces encountered in a connection with the improved connector of the invention.

In the prior art, the line from 80 to 81 represents the resistance encountered during the initial insertion of the second connector into the slot, while the latch 10 is being flexed from its initial contact with the side of the slot 23, until the resistance reaches its highest at about 27 pounds at point 81.

The contact of the straight lever 11 of prior art latch 10 is relatively close to the pivot 12 during this travel. At 81, there is a drop off in resistance during travel to point 82 to about 10 pounds. The straight lever latch 10 of the prior art during this drop off, contacts the side of the slot 23 further out along its straight lever 11, as it travels through the slot 23, so less force is necessary, since the lever arm is longer than at the initial contact.

At 82 there is a rise again in resistance due to the flexing of the detents 31 and 33 and connector ends 30 and 32 while they are forming a connector-to-connector lock. The resistance rises to point 83 at which point the connector-to-connector lock is completed, and all elements have reflexed to a rest position with no further resistance or movement occurring.

The forces required to overcome the resistance encountered in making a connection with the improvement of the invention is shown graphically in FIG. 4*a*. The same movement of the second connector 22 into the slot 23, having the latch of the invention 40, is shown, as was shown with the prior art connector, in FIG. 4*a*. Initial contact with the side of the slot 23 occurs at 90 and rises to 91 where there is a resistance of about 14 pounds. There is a very slight drop off in resistance as the latch of the invention 40 passes through the slot. The resistance then rises to point 93 at about 16 pounds while the connector-to-connector lock is being formed as the detents 31 and 33 and connector ends 30 and 32 are flexing, after which there is a drop off at point 94, where all resistance ends after the connector-to-connector lock is formed.

The force necessary, and the distance over which the force must be applied, is obviously remarkably less, in making the connection, with the present improvement in the connector.

FIG. 4*c* overlaps the charts of FIGS. 4*a* and 4*b*, with the locked position of the prior art connection, and the connection of the invention as an overlapped common point along the horizontal axis at 96. $\Delta X$ in the chart represent the distance of the delay in contact between the prior art latch 15, and the latch of the invention 40, with the side 17 of the slot 23, as the second connector into the slot is being inserted. Again, FIG. 4*c*, in chart form, represents the substantial reduction in force, and work necessary to make the present connection, over that to make the prior art connection.

What is claimed is:

1. In a suspended ceiling grid connection, a connector-to-connector lock between opposing first and second identical connectors, each on the end of a cross beam, that extend through a slot in a main beam from opposite directions, with a cantilevered locking latch extending from a base in each such first and second identical connectors capable of forcing the connectors into locking contact with each other within the slot;

the improvement comprising:

a cantilevered locking latch extending in a curve before extending in straight line fashion, wherein the curve is capable of delaying forced contact of a second identical connector being stabbed through the slot with an opposing first identical connector already in the slot, whereby the second identical connector is capable of being adjusted vertically without being forced against the first identical connector already in the slot by the locking latch in contact with a side of the slot.

* * * * *